US005204675A

United States Patent [19]

Sekine

[11] Patent Number: 5,204,675

[45] Date of Patent: Apr. 20, 1993

[54] TOLL COLLECTING SYSTEM FOR A VEHICLE

[75] Inventor: Hiroyoshi Sekine, Saitama, Japan

[73] Assignee: Kabushiki Kaisha Toshiba, Kanagawa, Japan

[21] Appl. No.: 685,651

[22] Filed: Apr. 16, 1991

[30] Foreign Application Priority Data

Apr. 18, 1990 [JP] Japan ..... 2-102296

[51] Int. Cl.[5] ..... G08G 1/01

[52] U.S. Cl. ..... 340/933; 340/928; 340/937; 340/941

[58] Field of Search ..... 340/933, 937, 941, 928, 340/825.27, 825.34; 364/436, 424.01, 406; 194/901

[56] References Cited

U.S. PATENT DOCUMENTS 3,602,881 8/1971 Bayne et al. ..... 340/928
4,303,904 12/1981 Chasek ..... 340/928

FOREIGN PATENT DOCUMENTS 1-259484 10/1989 Japan .
0018692 1/1990 Japan ..... 340/928

OTHER PUBLICATIONS

Automatic Vehicle Identification, AMTECH, Apr. 1988.

*Primary Examiner*—Donnie L. Crosland
*Attorney, Agent, or Firm*—Finnegan, Henderson, Farabow, Garrett & Dunner

[57] ABSTRACT

A system for collecting a toll for a vehicle, on which a vehicle number plate is mounted, is disclosed. In the system, a radio card as a storage medium is provided in the vehicle. The radio card generates a data signal representing a identification data including a vehicle number data. A radio card access system receives the data signal transmitted from the radio card and processes the data signal to obtain the vehicle number data contained in the radio card. A TV camera picks up an image corresponding to a vehicle number from the number plate of the vehicle. The radio card access system generates vehicle number plate data from the image picked up by the TV camera. The radio card access system compares the vehicle number data and vehicle number plate data and verifies whether or not the two sets of data coincide, the toll of the vehicle is calculated in accordance with the identification data stored in the storage medium.

6 Claims, 4 Drawing Sheets

TOLL COLLECTING SYSTEM FOR A VEHICLE

BACKGROUND OF THE INVENTION

1. Field of the Invention

The present invention relates to a toll collecting system for a vehicle in toll roads.

2. Description of the Related Art

In toll roads such as high speed roads there is often a means for collecting the toll.

One way of collecting tolls for toll roads involves staff stopping each vehicle at a toll gate and handing out a card indicating the point at which the vehicle entered the toll road. A toll determined by the card indicating the point of entry is then collected from vehicles leaving the toll road.

At the Dallas North Tollway and Greater New Orleans Bridge No. 2 in the U.S.A., toll collecting systems are used that employ a noncontact type data carrier.

In this type of toll collecting system, the user passing through the toll road purchases a data carrier, called a tag, beforehand. Data can be written to or read from this data carrier using microwaves. The user passes along the toll road with the tag stuck to the inside of the vehicle windscreen.

The individual number of the tag is identified at the toll stations at the entrances to the toll road by using microwaves generated by a read-write processing device provided at the toll station to access the tag. The toll for passage along the road is then automatically paid from the tag user's bank account or the like.

However, at toll stations having more than one lane provided with a read/write processing device, interference sometimes occurs due to some of these read-write processing devices communicating with the tags of vehicles passing in adjacent lanes, or with the tag of the following vehicle.

SUMMARY OF THE INVENTION

It is an object of the present invention to provide a toll collecting system which is capable of accurate vehicle identification and preventing interference on data access.

According to the present invention there is provided a system for collecting a toll for a vehicle carrying a number plate and a storage medium, the storage medium stores vehicle identification data including vehicle number data, the system comprising means for receiving the vehicle identification data from the storage medium via the wireless transmission path, means for obtaining vehicle number plate data from the number plate, means for verifying the vehicle number data included in the vehicle identification data received by the receiving means and the vehicle number plate data obtained by the obtaining means, and means for calculating the toll of the vehicle in accordance with the identification data stored in the storage medium when the vehicle number data has a predetermined relation to the vehicle number plate data.

DETAILED DESCRIPTION OF THE PREFERRED EMBODIMENT

Referring to the accompanying drawings, a detailed description will subsequently be given of the preferred embodiment of the present invention.

Figure 1:
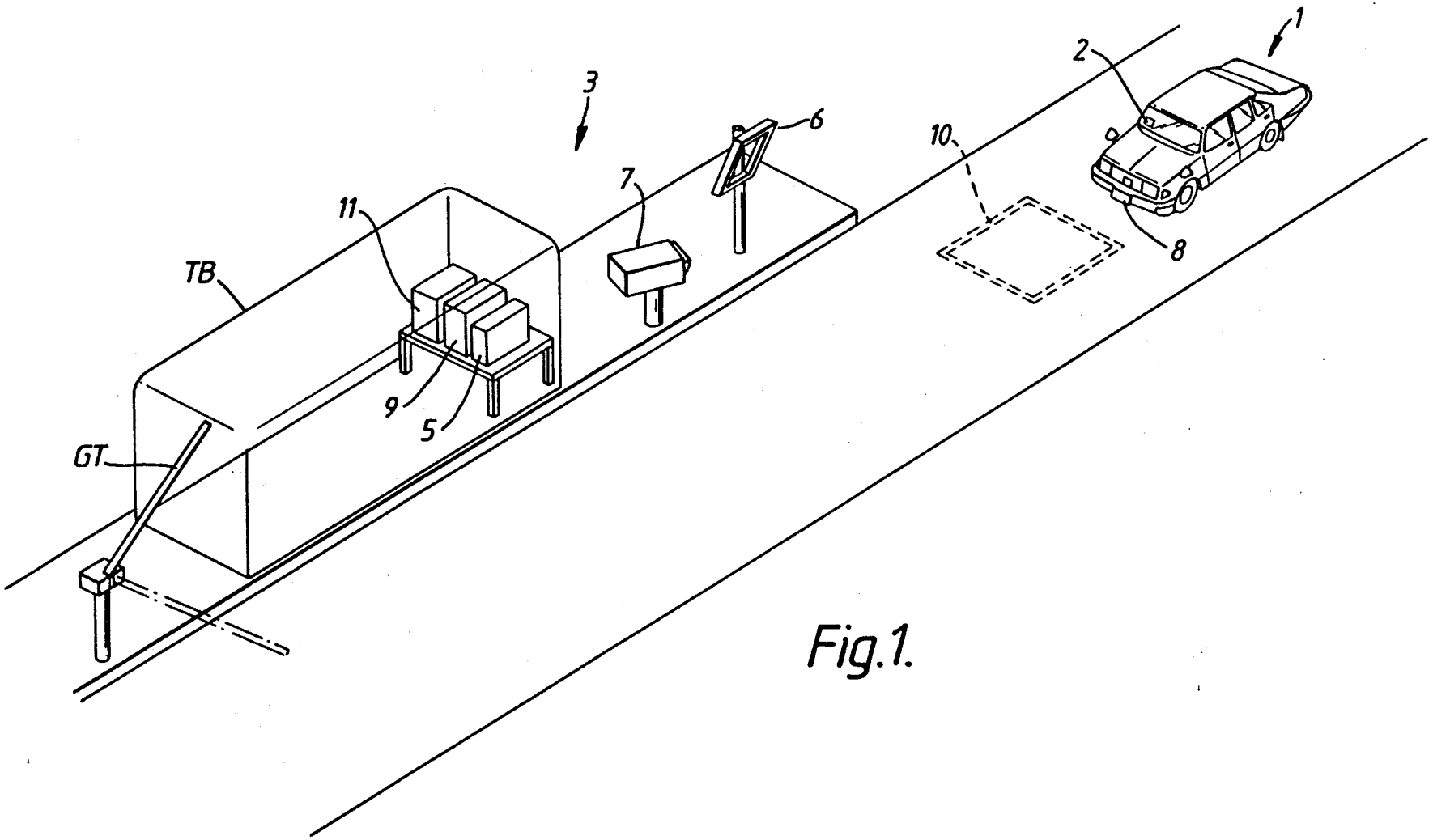
FIG. 1 is a perspective view showing a toll station where a toll collecting system of the present invention is installed.
Figure 2:
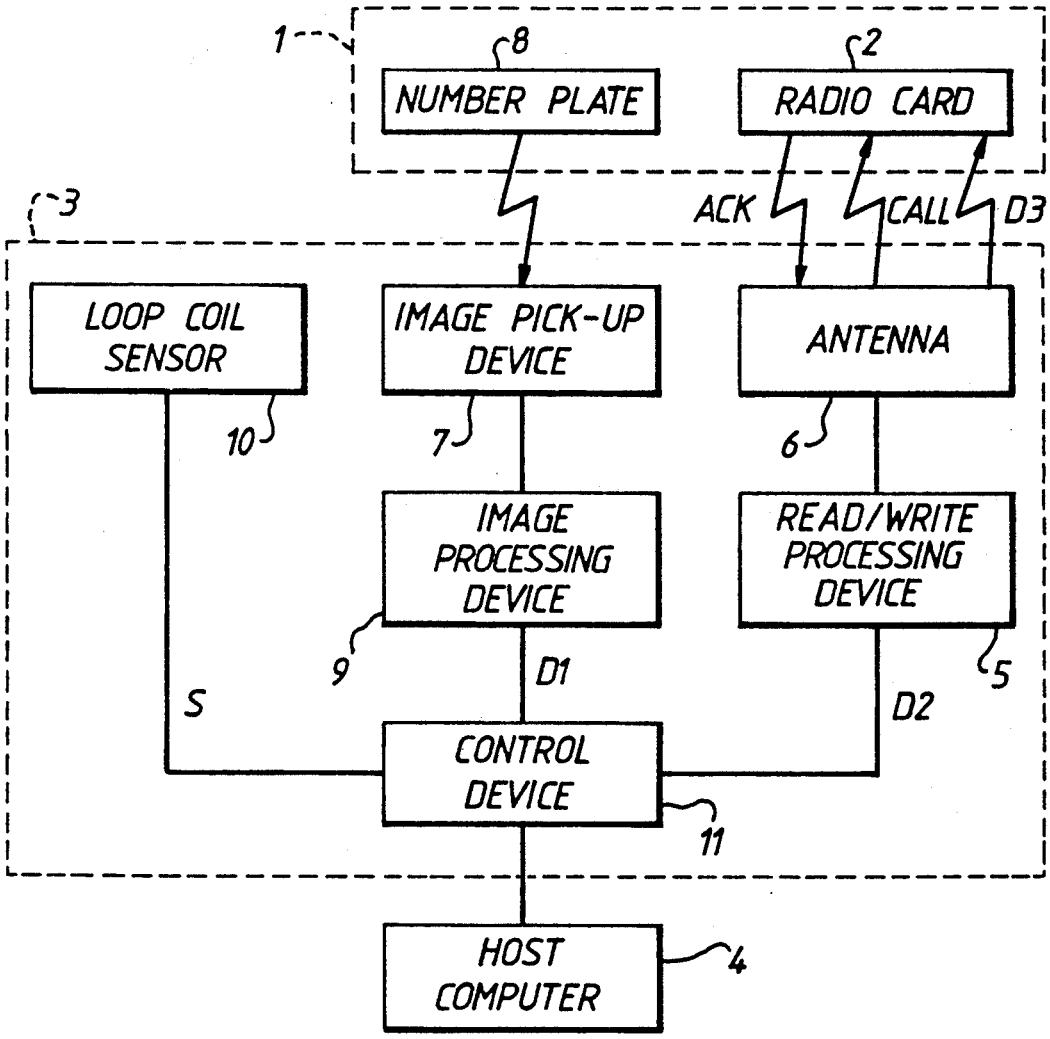
FIG. 2 is a block diagram showing the toll collecting system according to an embodiment of the present invention.

FIGS. 1 and 2 shows a toll collecting system according to one embodiment of the present invention.

The toll collecting system comprises a radio card 2 as a storage medium placed on the dashboard in a vehicle 1, a radio card access system 3 provided at the toll station, and a host computer 4.

Radio card 2 is provided with an internal memory in which the vehicle number is written beforehand. Radio card 2 also incorporates a transceiver, whereby the contents of the memory in radio card 2 can be written and read by accessing radio card 2 by microwaves.

Figure 3:
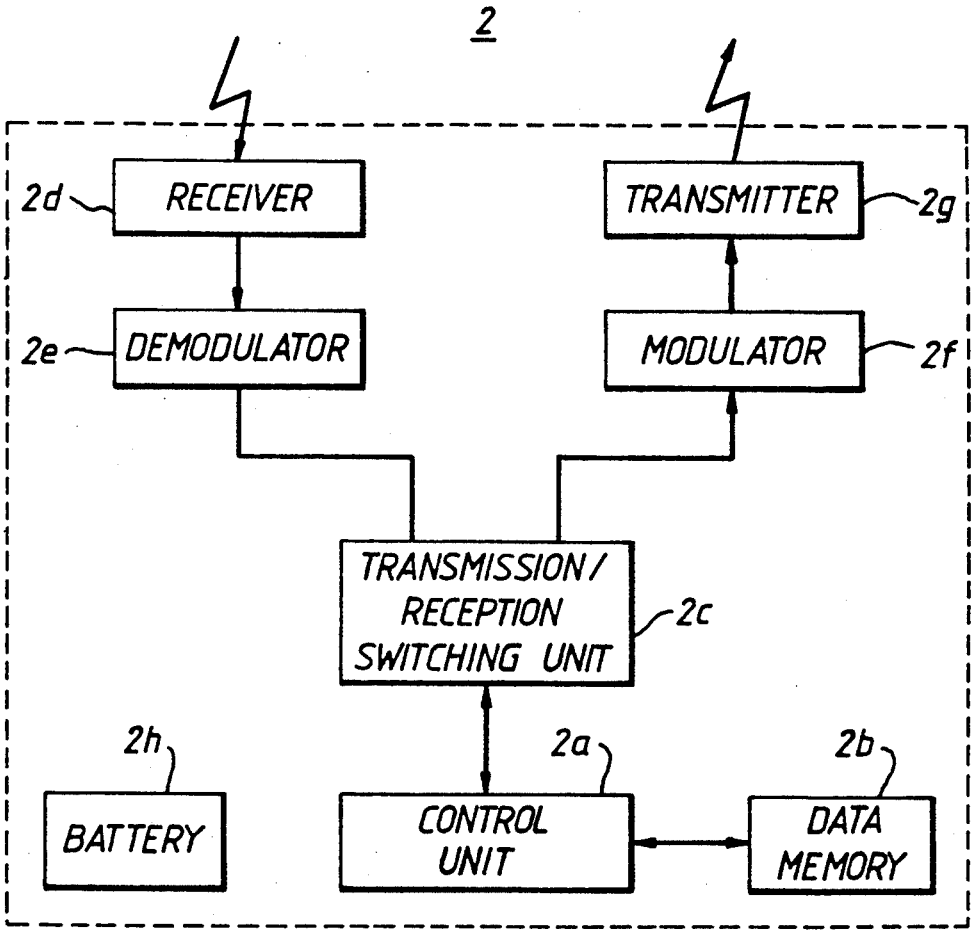
FIG. 3 is a block diagram showing a radio card used in the toll collecting system shown in FIG. 2.

That is, as shown in FIG. 3, the construction of the radio card 2 comprises a control unit **2*a* operatively connecting to elements described later, holding operating commands to operate the elements and holding processing commands to process the data applied from the elements; a data memory 2*b* connected with control unit 2*a* for storing a control program and vehicle identification data described later including number data corresponding to the vehicle number, user's account number and/or the cash value data and significant data relative to the vehicle; a transmission/reception switching unit 2*c* connected with control unit 2*a* for switching between the transmission of the information and the reception of the information based on the operating commands from control unit 2*a*; a receiver 2*d* for receiving a signal from radio card access system 3 in accordance with the switching operation of transmission/reception switching unit 2*c*; a demodulator 2*e* connected with receiver 2*d* and transmission/reception switching unit 2*c* for demodulating the signal from receiver 2*d* and transmitting the demodulated signal to transmission/reception switching unit 2*c*; a modulator 2*f* connected with transmission/reception switching unit 2*c* for modulating the number data, which are read out from data memory 2*b* and processed by control unit 2*a* then transmitted from control unit 2*a* to modulator 2*f* via transmission/reception switching unit 2*c*, into a data signal; a transmitter 2*g* connected with modulator 2*f* for transmitting the signal from the modulator 2*f* to the radio card access system 3 via the wireless transmission path; and a battery 2*h* for supplying a power source voltage to respective elements in the radio card 2**. The above elements may be contained in an IC chip and formed on one substrate in a card shape.

Returning to FIGS. 1 and 2, the construction of radio card access system 3 will now be described.

At the toll station, a read/write procesing device 5, an image processing device 9 and a control device 11 are installed in a toll booth TB, which is built along a road. Control device 5 connects to read/write processing device 5 and image processing device 9. At the outside of the booth TB and upstream along the road, an antenna 6, which is connected with read/write processing device 5, and an image pick-up device 7 such as a TV camera, which is connected with image processing device 9, are arranged. Antenna 6 via the transmission path receives microwaves containing vehicle identification data from radio card 2 provided in vehicle 1, and image pick-up device 7 picks up the image of a number plate 8 mounted on the vehicle 1 to obtain vehicle number plate data. Antenna 6 also via the transmission path transmits microwaves containing signal, which is supplied from read/write processing device 5, to radio card 2. Further at the upstream of the road, a loop coil sensor 10, which is connected with control device 11, is embedded in the road to sense the passage of the vehicle 1 and output a sensing signal to control device 11. Pick-up device 7 is activated by control device 11 in response to the sensing signal being received by the control device 11. At the down stream along the road, a gate GT is swingably arranged to allow the passage of the vehicle or interrupt the passage of the vehicle in accordance with the signal from control device 11.

Read/write processing device 5 receives microwaves containing signal from antenna 6 and transmits the signal to control device 11. Read/write processing device 5 also receives signal from control device 11 and transmits the signal to antenna 6. Image pick-up device 7 takes a picture of number plate 8 mounted on vehicle 1 and outputs an image of the number plate 8 to image processing device 9. Image processing device 9 discriminates the vehicle number written on the number plate 8 from the image output from image pick-up-device 7 and outputs vehicle number data to control device 11. Loop coil sensor 10 senses the passage of vehicle 1 and outputs a sensing signal to control device 11.

Control device 11 controls the overall operation of read/write processing device 5 and image processing device 9 in accordance with the detection signal input from loop coil sensor 10.

Radio card access system 3 is connected to host computer 4 via control device 11 so that the data output from control device 11 is transmitted to host computer 4.

If a charge system for using the toll road is a flat rate in the extended overall sections, the toll station according to the present invention, as shown in FIG. 1, is provided at one of the entrance and exit of the toll road and operate to withdraw the amount of the toll from the user's account or the cash value data stored in radio card 2. If the charge system for using the toll road is established in accordance with the distance, the toll stations according to the present invention are provided at the entrance and exit of the toll road. In the toll station at the entrance of the toll road, image pick-up device 7 reads out the vehicle number from the image of number plate 8, and read-write processing device 5 receives the information from radio card 2 via antenna 6. In response to the reception of the information from radio card 2, entrance information such as a number or code representing the toll station, to which the vehicle enters, is written into radio card 2. In the toll station at the exit of the toll road, image pick-up device 7 reads out the vehicle number from the image of number plate 8, and read-write processing device 5 receives the information from radio card 2 via antenna 6 to write exit information such as the amount of the toll, etc. into radio card 2.

Figure 4:
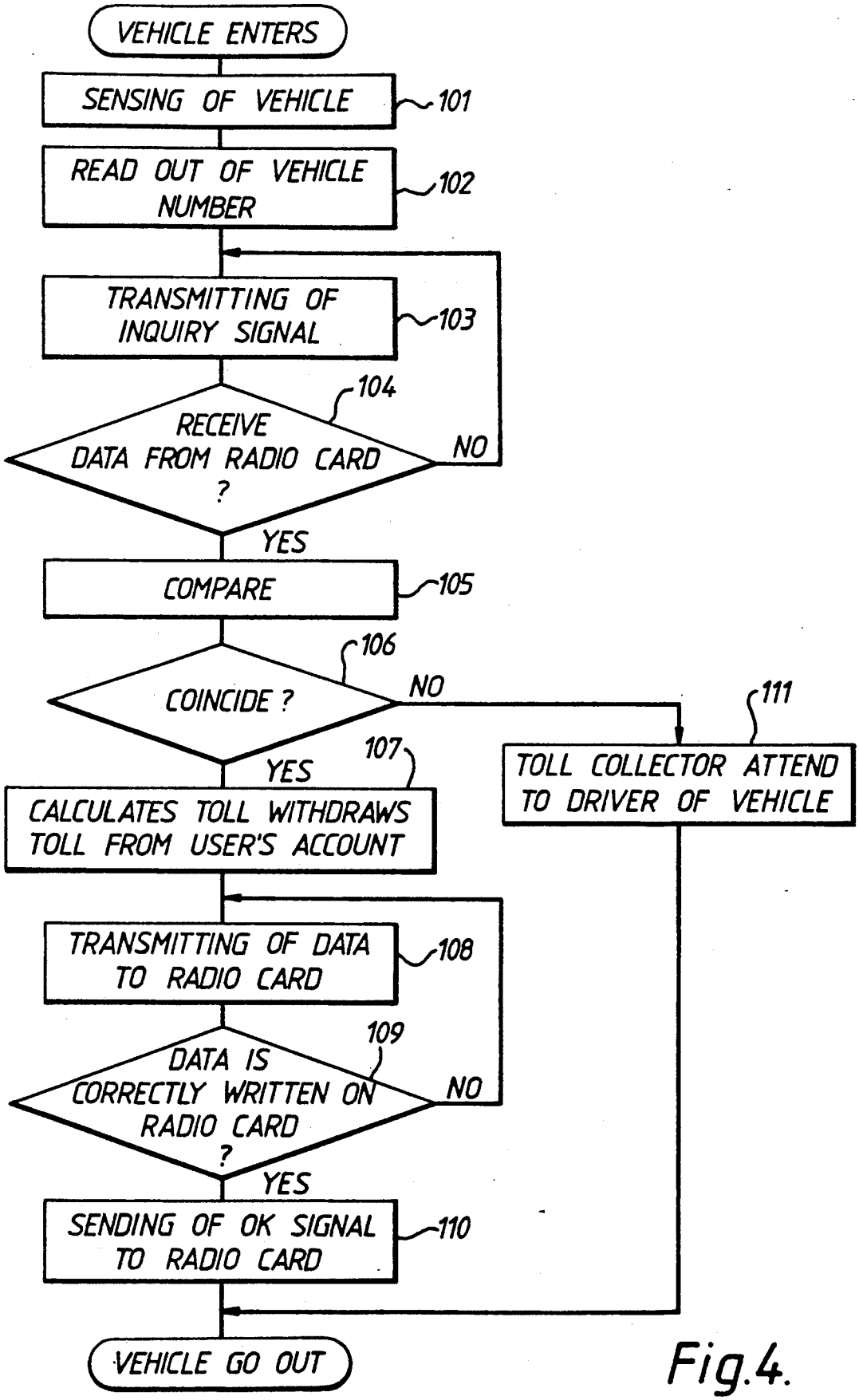
FIG. 4 is a flow chart showing the operation of the toll collecting system shown in FIG. 1.

The operation of the vehicle detection device constructed as above including the charging operation of the amount of the toll will now be described with reference to the flow chart shown in FIG. 4.

When vehicle 1 enters a lane in a toll station that is provided with radio card access system 3, loop coil sensor 10 senses the entry of vehicle 1 into the lane, and outputs a detection signal S to control device 11 (step 101).

In response to the input of the sensing signal S to control device 11 from loop coil sensor 10, control device 11 actuates image processing device 9. This causes image processing device 9 to identify the vehicle number from the image of number plate 8 captured by image pick-up device 7 and send vehicle number data D1 to control device 11 (step 102).

Control device 11 also actuates read/write processing device 5. Read/write processing device 5 transmits an inquiry signal CALL to radio card 2 of vehicle 1 via antenna 6. This inquiry signal CALL is transmitted until an acknowledgement signal ACK is received from radio card 2 (steps 103 and 104).

When radio card 2 receives inquiry signal CALL transmitted from radio card access system 3 via antenna 6, the transceiver housed in the radio card 2 goes into message exchange mode, and the transceiver transmits a signal including the vehicle number data D2 of vehicle 1 to radio card access system 3.

When read-write processing device 5 receives this signal through antenna 6 of radio card access system 3, read-write processing device 5 sends vehicle number data D2 to control device 11.

Control device 11 then compares vehicle number data D1 which is identified by image processing device 9 with the vehicle number data D2 sent from read/write processing device 5 to verify information included in each of data D1 and D2 (step 105).

If the result of this comparison is that the vehicle number data D1 and vehicle number data D2 are found to be the same or to be related information each other, control device 11 informs host computer 4 that they are the same. Host computer 4 then calculates the toll for the vehicle in accordance with vehicle number data D2 and withdraws the amount of the toll from the user's account (steps 106 and 107).

Control device 11 of card access system 3 then transmits a signal containing data D3 including the amount of the toll, the date, and the name of toll station etc., to radio card 2 through read/write processing device 5 and antenna 6 (step 108).

Radio card 2 receives and stores the data D3 of the signal in the internal memory thereof, then radio card 2 transmits a signal containing this data D3 to antenna 6. Read/write processing device 5 receives this signal through antenna 6 of card access system 3 and checks to see whether data D3 has been correctly written to radio card 2 or not. If the data D3 has not been correctly written to radio card 2, control returns to step 108, and read/write processing device 5 once more sends a signal containing data D3 to radio card 2 (step 109).

If the data D3 has been correctly written to radio card 2, read/write processing device 5 sends a signal OK indicating that the data has been correctly written (step 110).

If in step 106 the vehicle number data D1 and vehicle number data D2 are found not to be the same, vehicle 1 is interrupted by the closing of the gate GT to be stopped on the lane so that a toll collector may attend to the driver of vehicle 1 (step 111). This might happen due to interference with the radio card of a vehicle proceeding in another lane, or with the card of a vehicle following behind vehicle 1, or radio card 2 of vehicle 1 is inappropriate for some other reason. In this step 111, the toll collector examines the radio card 2. In this examination, the toll collector reads out the data from radio card 2 by using a card reader (not shown), the amount of the toll is then calculated based on the read out data from the card reader. The toll collector receives the amount of the toll from the driver. If, the radio card 2 is identified as an unauthorized radio card, the toll collector receives the amount of the toll from the driver who has the unauthorized radio card, and the toll collector confiscates the radio card from the driver. After that, the toll collector permits the driver to leave the toll station.

Thus, since the toll collecting system of this embodiment compares the vehicle number recorded in radio card 2 with the vehicle number written on number plate 8 of vehicle 1, the vehicle can be accurately identified and interference with radio cards other than these of vehicle 1 can be prevented.

In this embodiment, the toll is calculated and the amount of the toll is withdrawn from the user's account in the step 107. However, the present invention is not limited to these, and the amount of the toll may be directly withdrawn from the monetary value of radio card 2 if the monetary value is given to radio card 2 previously.

Also, if the toll road is one in which the amount of the toll is determined by the distance travelled, unfair payments by substituting the radio card while on the road can be prevented.

As described above, with the toll collecting system of the present invention, data indicating the vehicle number transmitted from transmission means placed on the vehicle and data indicating the vehicle number read by vehicle number reading means are compared, so the vehicle can be accurately identified.

What is claimed is:

1. A system for collecting a toll for a vehicle carrying a number plate and a storage medium, the storage medium stores radio identification data including vehicle number data, the system comprising:

means for receiving the radio identification data from the storage medium via a wireless transmission path;

means for obtaining plate number data including a plate number from the number plate;

means for comparing whether or not the radio identification data coincides with the plate number data wherein the radio identification data is received by the receiving means from the storage medium and the plate number data is obtained by the obtaining means from the number plate; and means for calculating the toll of the vehicle in accordance with the identification data stored in the storage medium when the radio identification data coincides with the plate number data.

2. The system according to claim 1, wherein the obtaining means includes means for picking up the vehicle number plate data as an optical image.

3. The system according to claim 2, further comprising:

means for detecting a passage of the vehicle and generating a signal; and means for activating the picking up means in response to the signal.

4. A system for collecting a toll for a vehicle carrying a number plate and a storage medium, the storage medium storing radio identification data including vehicle number data, the system comprising:

means for receiving the radio identification data from the storage medium via a wireless transmission path;

means for obtaining plate number data including a plate number from the number plate;

means for comparing whether or not the radio identification data coincides with the plate number data wherein the radio identification data is received by the receiving means from the storage medium and the plate number data is obtained by the obtaining means from the number plate;

first calculation means for calculating the toll of the vehicle in accordance with the identification data stored in the storage medium when the radio identification data coincides with the plate number data;

means for reading the identification data from the storage medium; and second calculation means for calculating the toll of the vehicle in accordance with the identification data read by the reading means when the radio identification data differs from the plate number data.

5. The system according to claim 4, wherein the obtaining means includes means for picking up the vehicle number plate data as an optical image.

6. The system according to claim 5, further comprising:

means for detecting a passage of the vehicle and generating a signal; and means for activating the picking up means in response to the signal.

* * * * *

UNITED STATES PATENT AND TRADEMARK OFFICE

CERTIFICATE OF CORRECTION

PATENT NO. : 5,204,675

DATED : April 20, 1993

INVENTOR(S) : Hiroyoshi Sekine

It is certified that error appears in the above-indentified patent and that said Letters Patent is hereby corrected as shown below:

In the Abstract, line 16, after "cide", insert --. If so--.

Signed and Sealed this

Fifteenth Day of March, 1994

*Attest:*

Bruce Lehman

BRUCE LEHMAN

*Attesting Officer*

*Commissioner of Patents and Trademarks*